United States Patent [19]

Iijima

[11] 4,151,733

[45] May 1, 1979

[54] METHOD OF PRODUCING THRUST WASHERS

[75] Inventor: Yoshio Iijima, Nagoya, Japan

[73] Assignee: Daido Metal Company Ltd., Nagoya, Japan

[21] Appl. No.: 793,349

[22] Filed: May 3, 1977

[30] Foreign Application Priority Data

May 14, 1976 [JP] Japan ..... 51-55953

[51] Int. Cl.[2] ..... B21D 53/20

[52] U.S. Cl. ..... 72/168; 72/171

[58] Field of Search ..... 72/167, 166, 171, 168, 72/172, 170, 175, 700

[56] References Cited

U.S. PATENT DOCUMENTS

| | | | |
|---|---|---|---|
| 2,043,665 | 6/1936 | Iversen | 72/171 |
| 2,365,882 | 12/1944 | Kane | 72/167 |
| 3,704,616 | 12/1972 | Taira | 72/167 |
| 3,842,473 | 10/1974 | Cooper | 72/166 |

*Primary Examiner*—Milton S. Mehr

*Attorney, Agent, or Firm*—Karl W. Flocks

[57] ABSTRACT

A method of producing thrust washers in which a blank material in the form of a flat bar is forced to pass between an upper and a lower forming rolls arranged as a pair. The blank material is pressed onto one of the forming rolls to be bent in the breadthwise direction to become a thrust washer. The upper and the lower rolls cooperate with each other in defining therebetween a groove having a configuration corresponding to the cross section of the article to be obtained, through which the blank is made to pass. This method ensures an economical production of ring-shaped or arcuately shaped articles having accurate dimensions.

4 Claims, 7 Drawing Figures

METHOD OF PRODUCING THRUST WASHERS

The present invention relates to a method of producing thrust washers.

Conventionally, several methods as mentioned below have been proposed and actually used for the production of these articles.

(1) Punching out of the ring-shaped or arcuately shaped article blank of required shape and dimension from plate material.

(2) To wind a blank bar material in its breakthwise direction around a core.

(3) To produce a cylindrical article by subjecting a bar shaped material to a bending in the thicknesswise direction by a pair of forming rolls.

The method as mentioned in the above item (1) has been found unsatisfactory because a large part of the material has to be uneconomically wasted.

In the methods of above items (2) and (3), the final product is inevitably apt to exhibit crackings in its peripheral portion, because the blank material is bent and formed without being enclosed by a pair of forming rolls, as well as lack of dimensional accuracy in breadthwise and thicknesswise directions.

It is therefore an object of the present invention to provide an economical method of producing ring-shaped or arcuately shaped articles in which the bar shaped material is not wasted, thus resulting in an improved yield ratio.

It is another object of the invention to provide a method of producing thrust washers in which accuracy of the dimensions is so improved that any further working subsequent to the roll forming can be dispensed with.

It is still another object of the invention to provide a method according to which thrust washers are mass-produced within a shorter period by employing a roll-forming machine of relatively simple construction.

To these ends, according to the invention, there is provided a method of producing thrust washers including the steps of feeding a flat bar shaped blank into a groove between an upper and a lower forming rolls arranged in pair, and pressing the blank bar shaped material against one of the forming rolls by the aid of auxiliary means, characterized in that the bar shaped material is made to pass through a bore defining a closed section between the upper and the lower forming rolls so as to be bent in the breadthwise direction thereof.

Figure 1:
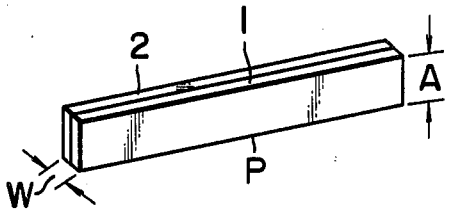
Figure 2:
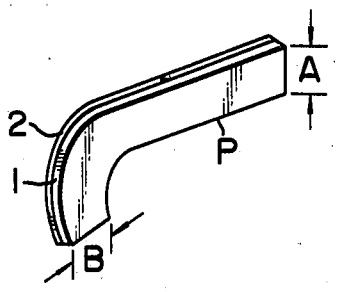
Figure 3:
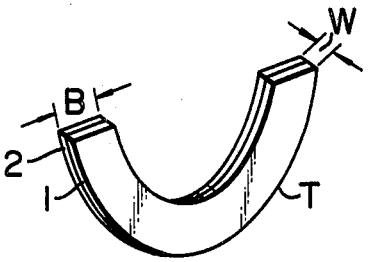

These and other objects, as well as advantageous features of the invention will become more clear from the following description of preferred embodiments taken in conjunction with the attached drawings in which:

FIGS. 1 to 3, in combination, show a process for forming a semi-circular hollow thrust washer adapted for use as a thrust bearing, wherein FIG. 1 is a perspective view of a bar shaped blank which constitutes a starting material, FIG. 2 is a perspective view of the blank bar partially bent in its breadthwise direction, FIG. 3 is a perspective view of a completed thrust washer.

Figure 4:
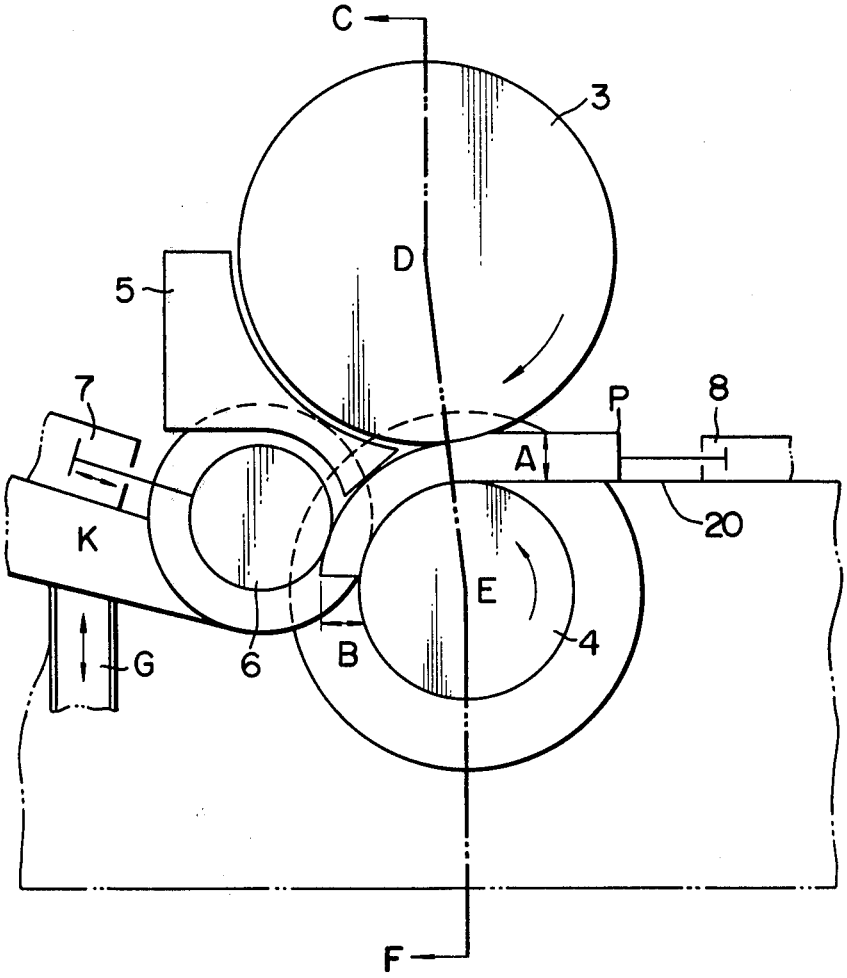
Figure 5:
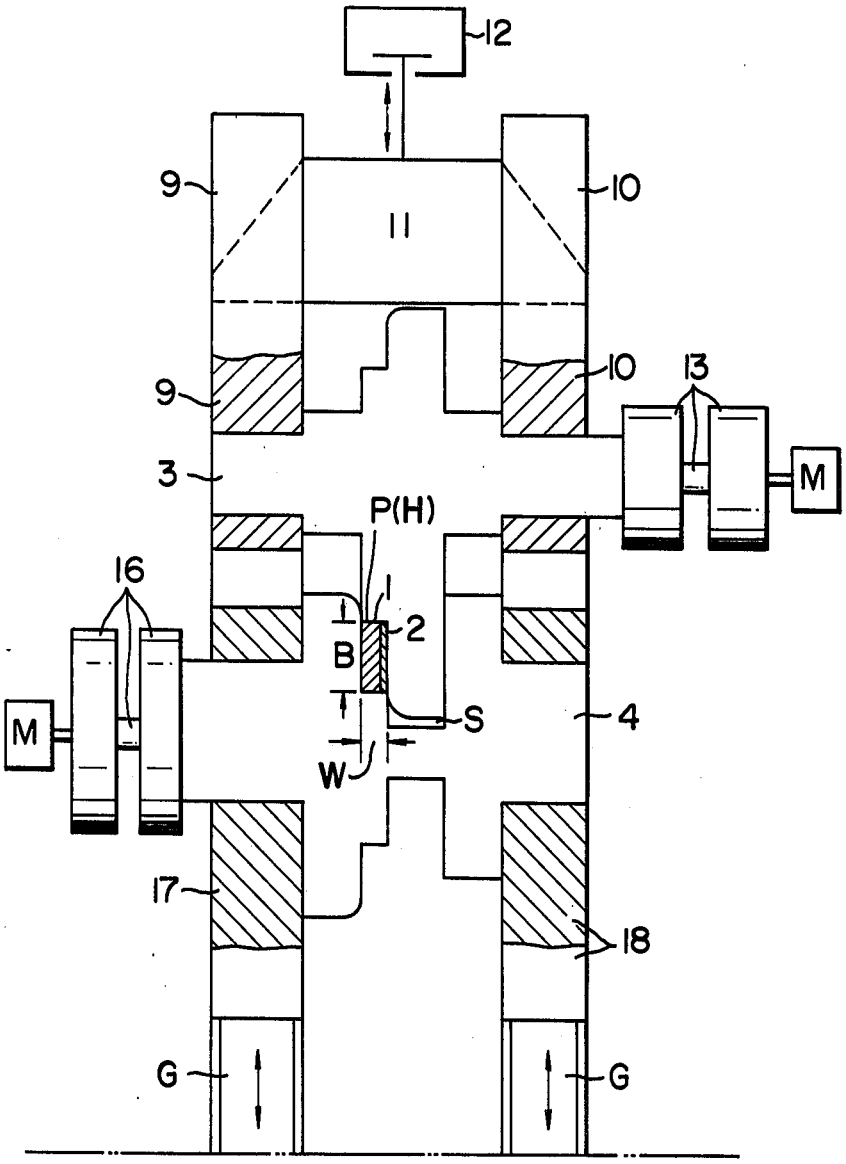
Figure 6:
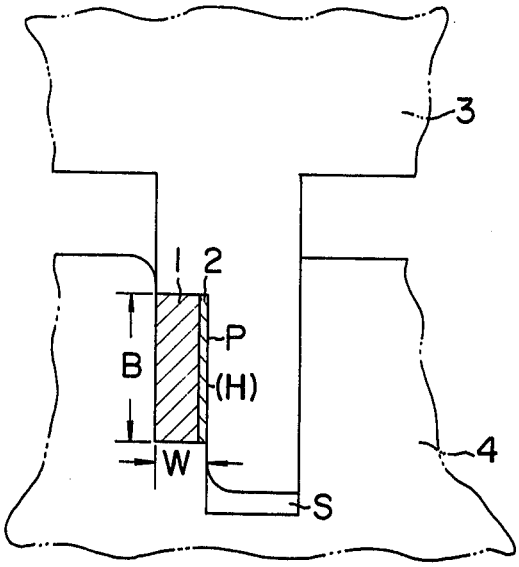
Figure 7:
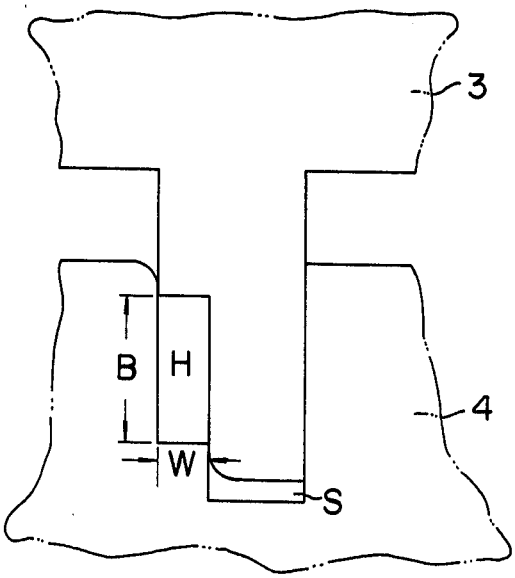

FIG. 4 is an explanatory illustration of the method for forming the thrust washer by an upper and a lower forming rolls arranged as a pair by the help of auxiliary means, in which a bar shaped blank material, i.e., the starting material is partially bent in its breadthwise direction, FIG. 5 is a sectional view taken along the line C-D-E-F of FIG. 4, FIG. 6 is an enlarged sectional view of a part of FIG. 5, and FIG. 7 is an explanatory illustration of a roll groove H having an enclosed section, formed between the upper and lower forming rolls arranged in pair.

The invention will be described hereinafter with specific reference to the illustrated preferred embodiments.

Referring at first to FIG. 1, a bar shaped material blank P is shown to have a backing plate 1 and a bearing material 2 bonded there with by casting or pressure-welded onto the backing plate 1.

The backing plate 1 may be made of steel or the like material, while the bearing material 2 may be of white metal, an aluminum alloy, a copper alloy or the like.

The breadth A of the starting bar material P must be larger than that B of the completed thrust washer as shown in FIG. 3. The dimension of the breadth A is selected suitably taking the mechanical properties, e.g. elongation ratio, hardness, tensile strength and so on, of the blank bar material P into account.

Now the process for forming the thrust washer is explained, at first an electric power source switch (not shown) is thrown. Then, as will be seen from FIGS. 4 and 5, a roll-reduction cylinder 12 is actuated to lower housings 9, 10 having an upper forming roll 3 to a predetermined position. A curling block 5 fixed to the housings 9 and 10 is accordingly maintained at a fixed position.

Then a screw mechanism G is actuated to lift a base unit K provided with housings 17, 18, an auxiliary roll 6 and a hydraulic cylinder 7 up to a raised position. The housings 17, 18 are provided with a lower forming roll 4.

In this state, the upper and the lower forming rolls 3, 4 cooperate with each other to define therebetween a bore H of a closed or confined section, as shown in FIG. 7.

A suitable gap S is maintained between the upper and the lower forming rolls 3, 4 (See FIGS. 5 to 7) so as to prevent the rolls from being damaged by collision with each other.

A switch (not shown) is turned on for actuating the upper and the lower forming rolls in this state, hydraulic means are energized to start a hydraulic motor M. The torque from the hydraulic motor M is transmitted to the upper and the lower rolls, through universal joints 13, 16, to cause rotations of the forming rolls 3, 4 in the directions shown by respective arrows in FIG. 4.

Subsequently, the elongated blank bar P of a bearing alloy bonded with a backing metal as shown in FIG. 1 is put on a table 20, and is fed by feeding means 8.

The blank bar P is forcibly fed and passes through the groove between the upper and the lower forming rolls 3, 4 and is subjected to a plastic deformation by a force exerted by a certain roll position and roll's torque.

As will be seen from FIGS. 5 and 6, the blank bar P is forced to pass through the bore H having a confined or closed section (See FIG. 7) defined by the upper and the lower forming rolls 3, 4.

As mentioned before, the longitudinal size B of the groove H is smaller than the breadth A of the blank bar P, in order to avoid cracking at the peripheral portion of the bar during the rolling, as well as to obtain a uniform or constant breadth of the final product.

As will be seen from FIGS. 5 to 7, the upper and the lower forming rolls 3, 4 are arranged to maintain a clearance W in the axial direction of the rolls, which well meets the thickness W of the blank bar P, so as to afford the final product a highly uniform thickness distribution over the entire length thereof, avoiding a thicknesswise spreading of the bar beyond a predetermined tolerance.

Subsequently, the blank bar P having passed through the groove H between the forming rolls 3, 4 comes to collide with the curling block 5 and is bent downwardly, to assume a half-finished form as shown in FIG. 2.

The speed of the upper and the lower forming rolls 3, 4 are arranged such that the peripheral or circumferential velocity of the upper forming roll 3 is always greater than that of the lower forming roll 4, thereby to smoothen the bending of the blank bar concurrently with the forming.

Then, the half-finished blank bar is forced to pass between the lower forming roll 4 and an auxiliary roll 6 urged or pressed by a hydraulic cylinder 7, thereby to impart a uniform stretch to the blank bar so as to obtain a final thrust washer T having accurately semi-circular configuration.

The formed thrust washer T is allowed to drop by gravity, as it leaves the auxiliary roll 6, thus completing the process.

Having described exemplarily a practical embodiment of the invention in which the method of the invention is applied to the production of hollow semi-circular thrust washers for use as thrust bearings, it is to be noted that the method of the invention is applicable to the production of articles having shapes other than arcuate.

Namely, for the production of ring-shaped articles, detachable auxiliary means such as a plurality of auxiliary rolls are additionally incorporated in combination with the upper and the lower forming rolls 3, 4.

As has been described, according to the invention, a blank bar is forced to pass through a confined bore defined between a pair of forming rolls, and is then bent in the breadthwise direction thereof.

Therefore, no cracking is caused in the periphery of the final thrust washer.

In addition, the method of the invention provides a greatly improved dimensional accuracy or precision in the breadthwise and thicknesswise directions of the final products, and enables economical mass-production of this kind of article.

What is claimed is:

1. A method of producing thrust washers comprising the steps of forcing a blank flat bar to pass through a confined or closed groove defined by upper and lower forming rolls arranged in a pair and provided with respective recesses having steps of a breadth substantially equal to that of the finished thrust washers, with said recesses of said forming rolls being adapted to cooperate with each other in defining said groove when said upper and lower forming rolls are brought into respective predetermined positions, said groove having a longitudinal size smaller than the breadth of said blank bar and a width substantially equal to the thickness of said blank flat bar, the tangential velocity of one of said forming rolls being smaller than that of the other;

engaging said blank flat bar with a curling block and an auxiliary roll means as it passes between said lower and upper rolls to hold said blank flat bar in close engagement with one of said rolls;

and bending said blank flat bar in its breadthwise direction by pressing it into one of said forming rolls by deflecting said blank flat bar with said curling block and said auxiliary roll means, after it passes through said groove between said forming rolls, through a second groove between said auxiliary roll means and one of said forming rolls.

2. The method of producing thrust washers as claimed in claim 1 wherein said blank flat bar includes a bearing material backed with a backing metal.

3. The method of producing thrust washers as claimed in claim 1 wherein said auxiliary roll means is urged against one of said forming rolls by a hydraulic cylinder means.

4. The method of producing thrust washers as claimed in claim 1 wherein said blank flat bar in the shape of a thrust washer is dropped by gravity from one of said forming rolls upon leaving contact with said auxiliary roll means.

* * * * *